US008734240B1

(12) United States Patent
Cummings

(10) Patent No.: US 8,734,240 B1
(45) Date of Patent: May 27, 2014

(54) METHOD AND SYSTEM FOR ADMINISTERING A LOTTERY IN COMBINATION WITH A PARI-MUTUEL POOL

(75) Inventor: Bradford Cummings, Louisville, KY (US)

(73) Assignee: Equilottery LLC, Lexington, KY (US)

( * ) Notice: Subject to any disclaimer, the term of this patent is extended or adjusted under 35 U.S.C. 154(b) by 0 days.

(21) Appl. No.: 13/354,532

(22) Filed: Jan. 20, 2012

Related U.S. Application Data

(60) Provisional application No. 61/434,845, filed on Jan. 21, 2011.

(51) Int. Cl.
*G07F 17/32* (2006.01)

(52) U.S. Cl.
CPC ..... *G07F 17/3288* (2013.01); *G07F 17/3258* (2013.01); *G07F 17/329* (2013.01); *G07F 17/32* (2013.01)
USPC ..... 463/28; 463/16; 463/17; 463/25

(58) Field of Classification Search
CPC ..... G07F 17/3244; G07F 17/3258; G07F 17/3272; G07F 17/3288; G07F 17/329
USPC ..... 463/16–20, 27–29
See application file for complete search history.

(56) References Cited

U.S. PATENT DOCUMENTS

| | | | | |
|---|---|---|---|---|
| 5,830,068 | A | 11/1998 | Brenner et al. | |
| 6,004,211 | A | 12/1999 | Brenner et al. | |
| 6,099,409 | A | 8/2000 | Brenner et al. | |
| 6,358,150 | B1 * | 3/2002 | Mir et al. | 463/28 |
| 6,722,980 | B2 * | 4/2004 | Stronach | 463/25 |
| 7,387,571 | B2 * | 6/2008 | Walker et al. | 463/26 |
| 2009/0186680 | A1 | 7/2009 | Napolitano et al. | |

* cited by examiner

*Primary Examiner* — Arthur O Hall
*Assistant Examiner* — Jasson Yoo
(74) *Attorney, Agent, or Firm* — Stites & Harbison, PLLC; David W. Nagle, Jr.

(57) ABSTRACT

In a method for administering a lottery in combination with a pari-mutuel pool, tickets are generated at point-of-purchase terminals, each ticket including a series of randomly generated or user-selected numbers. A portion of the purchase price of each ticket is allocated to the pari-mutuel pool and is treated as a wager in the pari-mutuel pool, while another portion of the purchase price may be allocated to other pools, including a supplemental payout pool. If the ticket is a winning ticket, a preliminary amount of a payout from the wager in the pari-mutuel pool is determined. In some cases, this preliminary amount is supplemented from monies in the supplemental payout pool.

13 Claims, 6 Drawing Sheets

METHOD AND SYSTEM FOR ADMINISTERING A LOTTERY IN COMBINATION WITH A PARI-MUTUEL POOL

CROSS-REFERENCE TO RELATED APPLICATIONS

The present application claims priority to U.S. Provisional Patent Application Ser. No. 61/434,845 filed on Jan. 21, 2011, the entire disclosure of which is incorporated herein by reference.

BACKGROUND OF THE INVENTION

The present invention is a method and system for administering a lottery in combination with a pari-mutuel pool.

Lottery games are a common form of gambling in which the winners are determined in some random manner. For example, each player may purchase a ticket with a random sequence of numbers. If that random sequence of numbers, or a portion of that sequence, is selected in a subsequent random drawing or selection of numbers, the player wins a cash amount that may be fixed or may be determined as a percentage of the receipts from tickets for that particular drawing. For another example, instant lottery tickets provide a player the opportunity to win a cash amount (or another prize) without waiting for a subsequent drawing. Specifically, an instant lottery ticket generally includes winning (or losing) numbers or icons that are concealed on the ticket itself. The numbers or icons are typically hidden by a coating. By removing this coating, the player can instantly determine whether or not it is a winning ticket rather than waiting for a subsequent drawing.

Another common form of gambling in pari-mutuel wagering, which is commonly used in connection with horse racing. In pari-mutuel wagering, all wagers (or bets) are collected in a pool. The house take is removed from the pool, and the payoff odds are then calculated by sharing the pool among all winning wagers. Thus, in pari-mutuel wagering, the payout odds go up and down depending on the amount of money wagered on each horse or group of horses. This allows for certain combinations of numbers to pay out more as compared to others. That being said, handicapping a horse race is difficult and is considered a skill, as skilled players place wagers based on past performances of the horses entered. While this is appealing to a certain minority of the public, most people do not understand how to handicap and, therefore, do not become long-term participants in the gambling side of the horse industry.

In short, the public has a clear desire to gamble but prefers games of complete chance like the lottery and slot machines, which are by far the two most profitable versions of gambling in the United States. Therefore, it would be desirable to combine a game of chance with a pari-mutuel pool (such as that associated with horse racing) to achieve a game with more progressive payouts, but without unduly increasing the complexity of the game.

SUMMARY OF THE INVENTION

The present invention is a method and system for administering a lottery in combination with a pari-mutuel pool. Such a method and system results in a game with more progressive payouts and greater excitement for the players. In other words, the method and system of the present invention combines the mass appeal of a lottery with the unpredictable and oftentimes exciting payouts of a pari-mutuel wagering system.

In an exemplary implementation of the method and system of the present invention, multiple point-of-purchase terminals, similar to the point-of-purchase terminals that are currently used in lottery operations, are provided at various retail locations. Using such point-of-purchase terminals, a ticket can be purchased in the same manner that current lottery tickets are purchased. Each ticket includes a series of randomly generated numbers. For example, to the extent that the ticket would be tied to a trifecta wager on a horse race, each ticket would include three randomly selected numbers that correspond to the entrants in a particular horse race. For another example, to the extent that the ticket would be tied to a superfecta wager on a horse race, each ticket would include four randomly selected numbers that correspond to the entrants in a particular horse race. For yet another example, to the extent that the ticket would be tied to a Pick 6 wager on six separate horse races, each ticket would include six randomly selected numbers that correspond to the entrants in those six horse races.

Each of the point-of-purchase terminals is in communication with a computer server and associated database to record the purchase of each ticket. That computer server is then in communication with another computer server and associated database that manages a pari-mutuel pool, such as that associated with a horse race.

When a ticket is purchased, a portion of the purchase price is treated as a wager and allocated to a pari-mutuel pool. The computer server communicates with the computer server managing the pari-mutuel pool and records the wager. Another portion of the purchase price is then allocated into other pools, including a supplemental payout pool.

At some future date, there will be a horse race or similar event that will determine a winning series of numbers. If a player has a matching ticket, i.e., the series of randomly generated numbers on the ticket matches the winning series of numbers from the outcome of horse race or similar event, the player is a winner and is entitled to a payout. The preliminary amount of the payout is determined by the amount generated by the wager in the pari-mutuel pool. A determination is made as to whether this preliminary amount exceeds a predetermined minimum amount. If so, that preliminary amount is treated as the final payout and awarded to the player. If not, the pool that is used to supplement winning payouts is accessed to make up the difference, and the predetermined minimum amount is treated as the final payout and awarded to the player.

Although the exemplary implementation of the method and system described above makes use of a supplemental payout pool, it should be recognized and understood that, in some embodiments, such a supplemental payout pool could be eliminated or modified.

In an alternative implementation of the method and system of the present invention, it is contemplated that the player could choose the numbers rather than rely on a series of randomly generated numbers. If that option was offered, it is still contemplated that a portion of the purchase price would be allocated to the pari-mutuel pool for entering a wager in the pari-mutuel pool, while another portion of the purchase price would be allocated to a separate pool. In such an implementation, the payout would be determined solely by the amount generated by the wager in the pari-mutuel pool. There would be no pool to supplement winning payouts.

In yet an alternative implementation of the method and system of the present invention, it is contemplated that the players could again choose their own numbers, while a supplemental pool was still available to ensure minimum payouts. In such a scenario, however, it is contemplated that the supplemental payout pool may provide a lesser payout as compared to the payout in the scenario when the numbers are randomly generated, so that it would not attract experienced handicappers trying to take advantage of the system, but it would still allow the casual lottery player the opportunity to play his own numbers.

DETAILED DESCRIPTION OF THE INVENTION

The present invention is a method and system for administering a lottery in combination with a pari-mutuel pool. Such a method and system results in a game with more progressive payouts and greater excitement for the players. In other words, the method and system of the present invention combines the mass appeal of a lottery with the unpredictable and oftentimes exciting payouts of a pari-mutuel wagering system.

Figure 1:
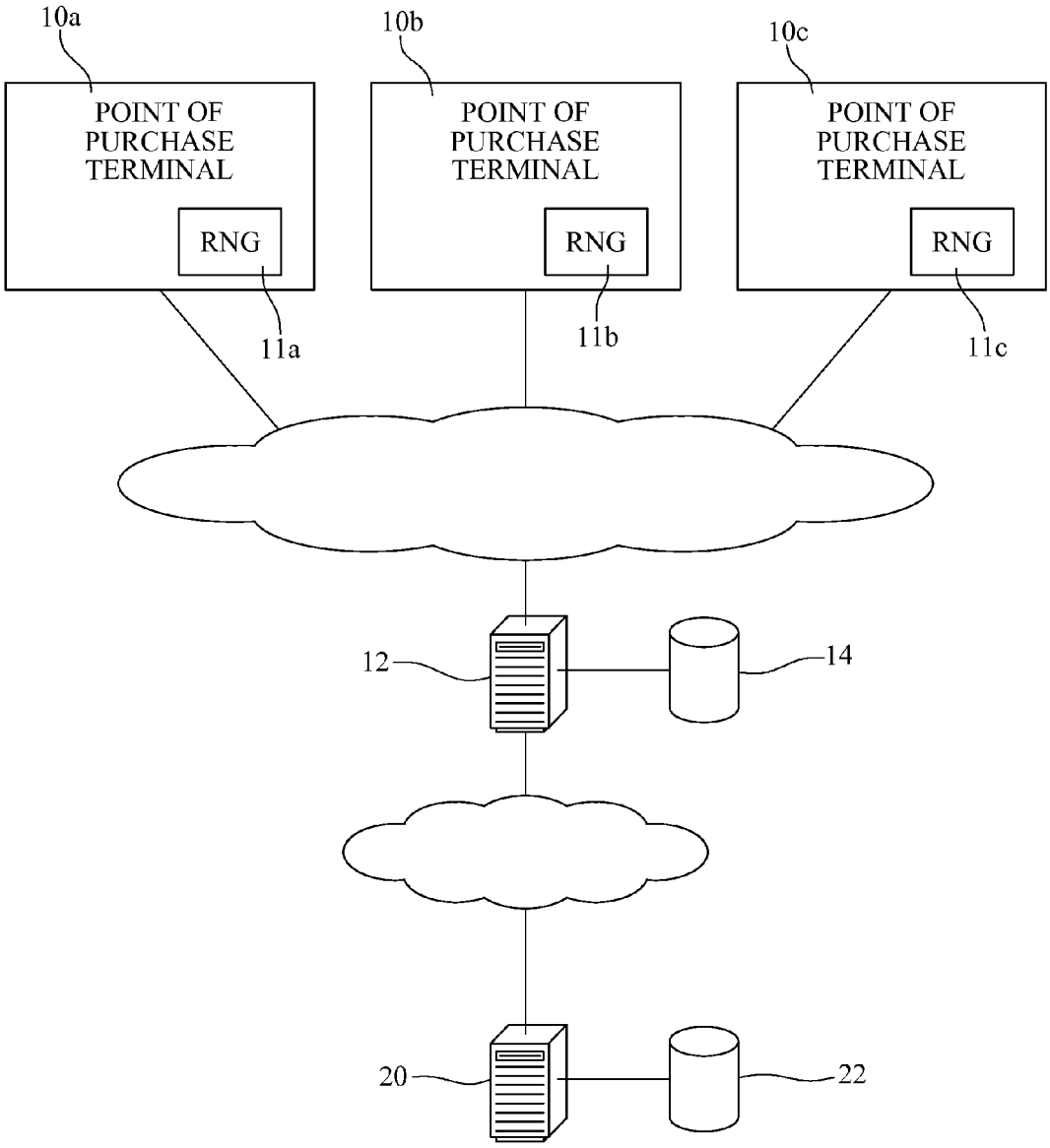
FIG. 1 is a schematic illustration of an exemplary implementation of the method and system of the present invention.

Referring now to FIG. 1, in an exemplary implementation of the method and system of the present invention, multiple point-of-purchase terminals 10*a*, 10*b*, 10*c* are provided at various retail locations, including, for example, grocery stores, convenience marts, and gas stations. Such point-of-purchase terminals 10*a*, 10*b*, 10*c* could even be accessible and available via the Internet. Similar to the point-of-purchase terminals that are currently used in lottery operations, each such point-of-purchase terminal 10*a*, 10*b*, 10*c* generally comprises a computer with one or more input means, such as a keyboard, mouse, touch screen, etc. Using such point-of-purchase terminals 10*a*, 10*b*, 10*c*, a ticket can be purchased in the same manner that current lottery tickets are purchased. In this regard, each ticket includes a series of randomly generated numbers. In other words, each point-of-purchase terminal 10*a*, 10*b*, 10*c* includes a software-implemented random number generator ("RNG") 11*a*, 11*b*, 11*c* that produces a series of randomly generated numbers for the ticket. For example, to the extent that the ticket would be tied to a trifecta wager on a horse race (as further discussed below), each ticket would include three randomly selected numbers that correspond to the entrants in a particular horse race. For another example, to the extent that the ticket would be tied to a superfecta wager on a horse race (as further discussed below), each ticket would include four randomly selected numbers that correspond to the entrants in a particular horse race. For yet another example, to the extent that the ticket would be tied to a Pick 6 wager on six separate horse races (as further discussed below), each ticket would include six randomly selected numbers that correspond to the entrants in those six horse races.

Referring still to FIG. 1, each of the point-of-purchase terminals 10*a*, 10*b*, 10*c* is in communication with a computer server 12 and associated database to record the purchase of each ticket. Such communications are preferably facilitated through an Internet connection, satellite communications, or similar known means of data transport. The computer server 12 is then in communication with another computer server 20 and associated database 22 that manages a pari-mutuel pool, such as that associated with a horse race. Such communications are again preferably facilitated through an Internet connection, satellite communications, or similar known means of data transport.

Figure 2:
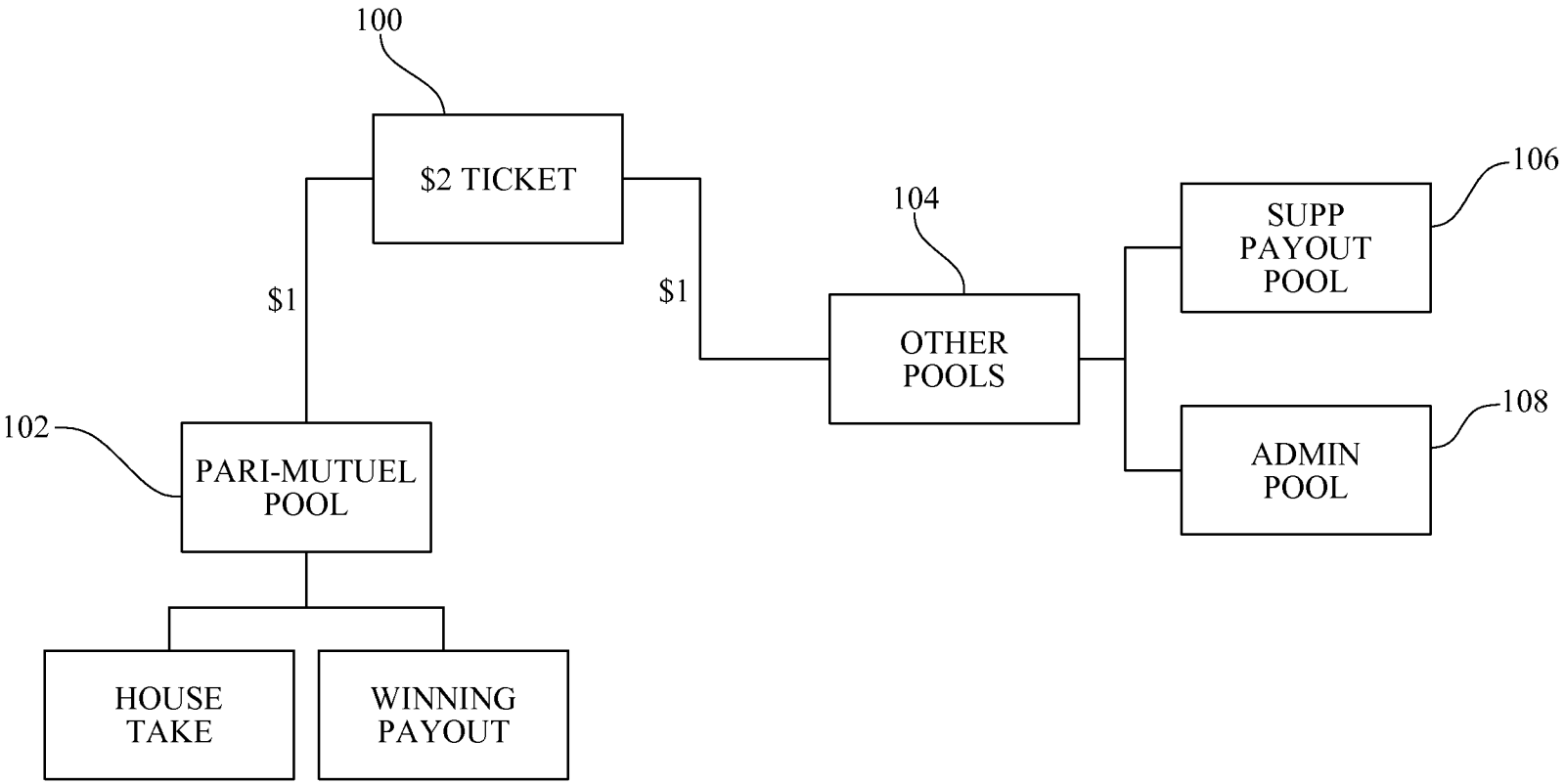
FIG. 2 is a diagram illustrating how the monies associated with the purchase of a ticket are allocated in an exemplary implementation of the method and system of the present invention.

FIG. 2 is a diagram illustrating how the monies associated with the purchase of a ticket are allocated, which assists in explaining how the lottery function is combined with pari-mutuel wagering. In the example illustrated in FIG. 2, a $2 ticket is purchased, as indicated by block 100. As part of that purchase, the player identifies which horse race or horse races he is "wagering" on. One dollar ($1) of the purchase price is then treated as a wager and allocated to the pari-mutuel pool, as indicated by block 102. In this regard, the above-described random number generator ("RNG") produces a series of randomly generated numbers for the ticket and wager. A three-digit series of numbers is randomly generated and treated as a trifecta wager on a particular horse race. A four-digit series of numbers is randomly generated and treated as a superfecta wager on a particular horse race. A six-digit series of numbers is randomly generated and treated as a Pick 6 wager on six separate horse races. Accordingly, the computer server 12 communicates with the computer server 20 managing the pari-mutuel pool (as illustrated in FIG. 1) and records the wager, such that a $1 wager is entered into the pari-mutuel pool. As with any pari-mutuel pool, and as described above, the house take (for profits, infrastructure, etc.) is removed from the pool, with the remaining funds used for winning payouts.

The second dollar ($1) of the purchase price is then allocated into other pools, as indicated by block 104. In this exemplary implementation, a first, supplemental payout pool 106 (SUPP PAYOUT POOL) is used to supplement winning payouts, as further described below. A second pool 108 (ADMIN POOL) is used for administrative expenses and/or other purposes, such as providing support to the horse racing industry in a particular location.

Figure 3:
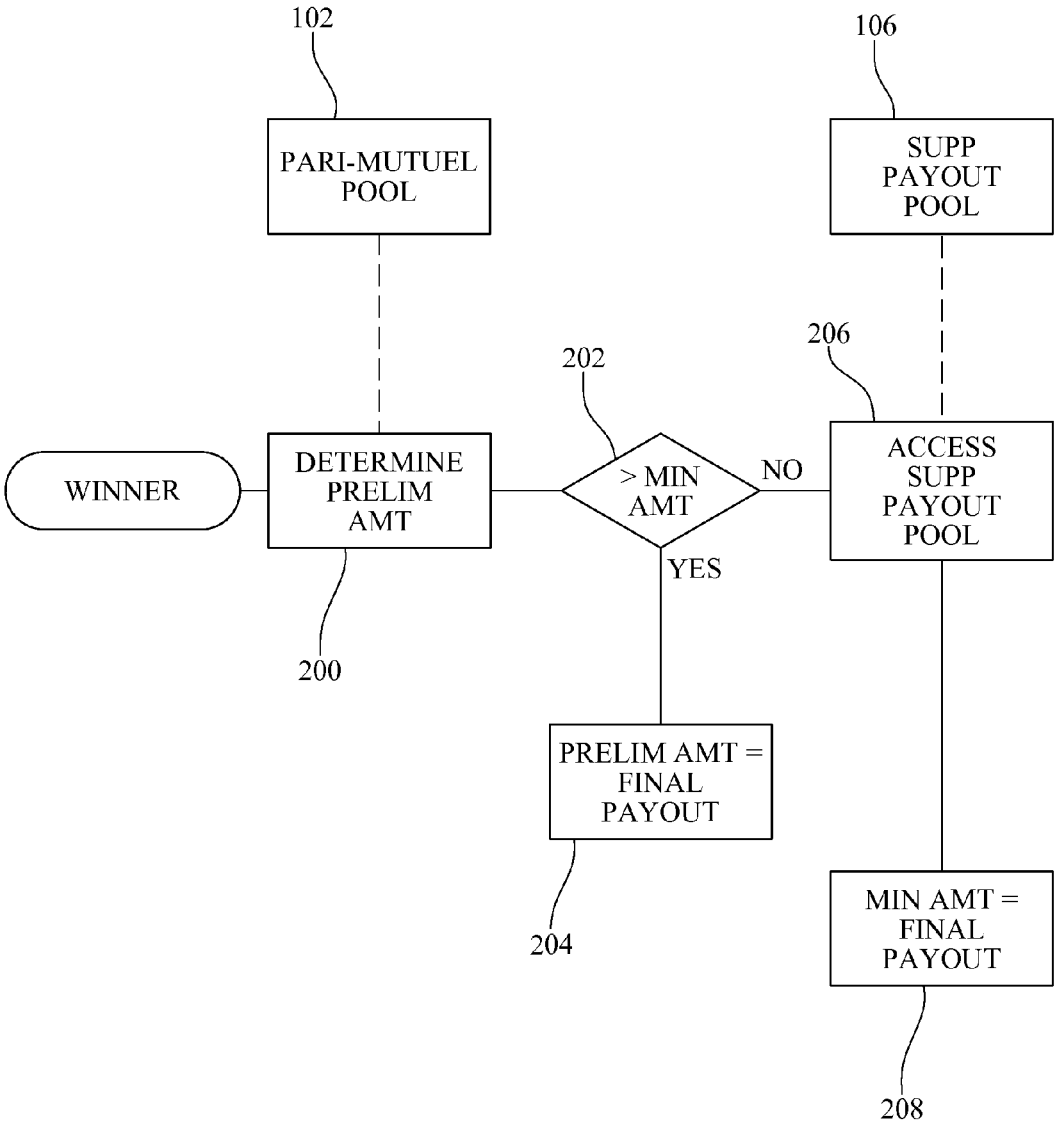
FIG. 3 is a flow chart illustrating the determination of a payout for a ticket in which the monies have been allocated as in FIG. 2.

Referring now to FIG. 3, at some future date, there will be a horse race or similar event that will determine a winning series of numbers. If a player has a matching ticket, i.e., the series of randomly generated numbers on the ticket matches the winning series of numbers from the outcome of horse race or similar event, the player is a winner and is entitled to a payout. The preliminary amount (PRELIM AMT) of the payout is determined by the amount generated by the $1 wager in the pari-mutuel pool, as indicated by block 200 of FIG. 3. In this regard, the amount generated by the $1 wager in the pari-mutuel pool is calculated by the computer server 20 managing the pari-mutuel pool and communicated back to the computer server 12. Then, a determination is made by the computer server 12 at decision 202 as to whether this preliminary amount (PRELIM AMT) exceeds a predetermined minimum amount (MIN AMT). If so, that preliminary amount (PRELIM AMT) is treated as the final payout (FINAL PAYOUT) and awarded to the player, as indicated by block 204. If not, the pool 106 that is used to supplement winning payouts is accessed to make up the difference, as indicated by block 206, and the predetermined minimum amount (MIN AMT) is treated as the final payout and awarded to the player, as indicated by block 208.

With respect to the entry of a wager into the pari-mutuel pool as described above with reference to FIG. 2, this may be the same pool as used at the racetrack or may be a separate pool that is established as part of the method and system of the present invention.

Thus, the method and system described above with reference to FIGS. 1-3 combines a lottery with a pari-mutuel pool, resulting in a game with more progressive payouts and greater excitement for the players. In other words, the mass appeal of a lottery is combined with the unpredictable and oftentimes exciting payouts of a pari-mutuel wagering system. Furthermore, from the perspective of a typical lottery player, the money being supplied in the pari-mutuel pool by horseplayers may be seen as a bonus, while, from the perspective of a typical horse player, the additional "amateur" money in the pari-mutuel pool is also perceived as beneficial and increases the payouts when perceived favorites win.

Lastly, although the exemplary implementation of the method and system described above with reference to FIGS. 1-3 makes use of a supplemental payout pool 106, it should be recognized and understood that, in some embodiments, such a supplemental payout pool 106 could be eliminated or modified without departing from the spirit and scope of the present invention.

In an alternative implementation of the method and system of the present invention, it is contemplated that the player could choose the numbers rather than rely on a series of randomly generated numbers. If that option was offered, it is still contemplated that a portion of the purchase price would be allocated to the pari-mutuel pool for entering a wager in the pari-mutuel pool, while another portion of the purchase price would be allocated to a separate pool or pools.

Figure 4:
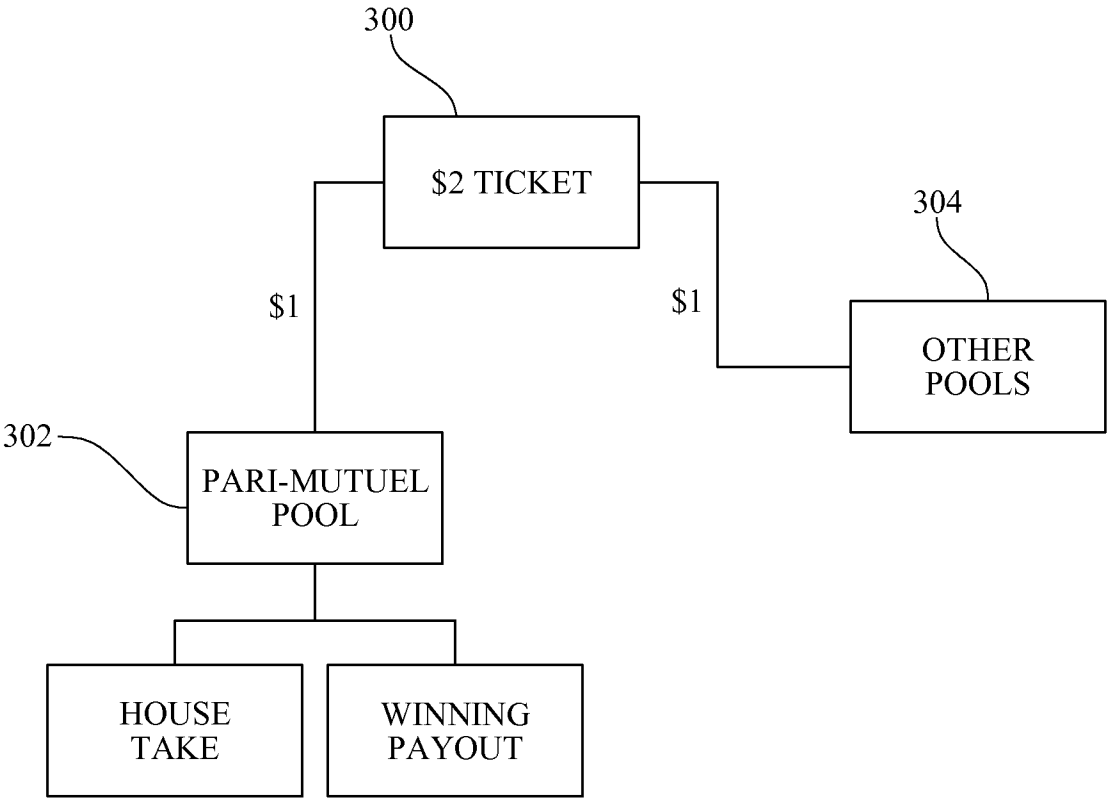
FIG. 4 is a diagram illustrating how the monies associated with the purchase of a ticket are allocated in another exemplary implementation of the method and system of the present invention.

For example, and referring now to FIG. 4, a $2 ticket is purchased, as indicated by block 300. As part of that purchase, the player identifies which horse race or horse races he is "wagering" on and provides the player-selected numbers for input into the point-of-purchase terminal. For example, such player-selected numbers could be filled in on a "bubble" sheet as is commonly used in current lottery games and then scanned by the point-of-purchase terminal. In this example, $1 of the purchase price is then treated as a wager and allocated to the pari-mutuel pool, as indicated by block 302. Accordingly, the computer server 12 communicates with the computer server 20 managing the pari-mutuel pool (as illustrated in FIG. 1), such that a $1 wager is entered into the pari-mutuel pool. Again, as with any pari-mutuel pool, and as described above, the house take (for profits, infrastructure, etc.) is removed from the pool, with the remaining funds used for winning payouts.

The remaining $1 of the purchase price is then allocated into other pools for administrative expenses and/or other purposes, such as providing support to the horse racing industry in a particular location, as indicated by block 304.

Thus, in this exemplary implementation, the payout would be determined solely by the amount generated by the wager in the pari-mutuel pool. There would be no pool to supplement winning payouts.

In yet an alternative implementation of the method and system of the present invention, it is contemplated that the players could again choose their own numbers, while a supplemental pool was still available to ensure minimum payouts. In such a scenario, however, it is contemplated that the supplemental payout pool may provide a lesser payout as compared to the payout in the scenario when the numbers are randomly generated, so that it would not attract experienced handicappers trying to take advantage of the system, but it would still allow the casual lottery player the opportunity to play his own numbers.

Figure 5:
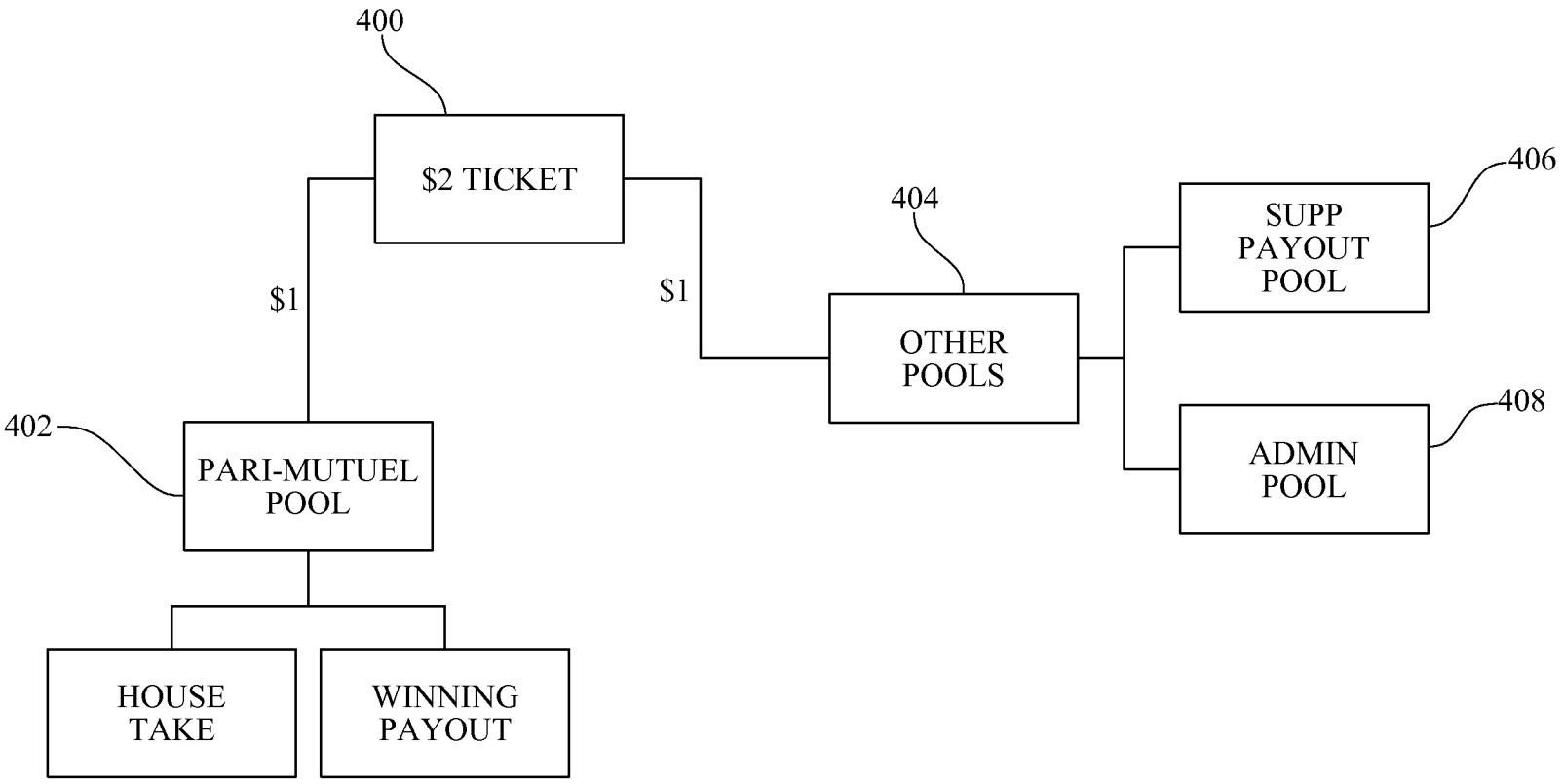
FIG. 5 is a diagram illustrating how the monies associated with the purchase of a ticket are allocated in yet another exemplary implementation of the method and system of the present invention.

For example, and referring now to FIG. 5, a $2 ticket is purchased, as indicated by block 400. As part of that purchase, the player identifies which horse race or horse races he is "wagering" on and provides the player-selected numbers for input into the point-of-purchase terminal. In this example, $1 of the purchase price is then treated as a wager and allocated to the pari-mutuel pool, as indicated by block 402. Accordingly, the computer server 12 communicates with the computer server 20 managing the pari-mutuel pool (as illustrated in FIG. 1), such that a $1 wager is entered into the pari-mutuel pool. Again, as with any pari-mutuel pool, and as described above, the house take (for profits, infrastructure, etc.) is removed from the pool, with the remaining funds used for winning payouts.

The remaining $1 of the purchase price is then allocated into other pools, as indicated by block 404. Similar to the implementation described above with respect to FIGS. 2-3, a first, supplemental payout pool 406 (SUPP PAYOUT POOL) is used to supplement winning payouts, and a second pool 408 (ADMIN POOL) is used for administrative expenses and/or other purposes, such as providing support to the horse racing industry in a particular location.

Figure 6:
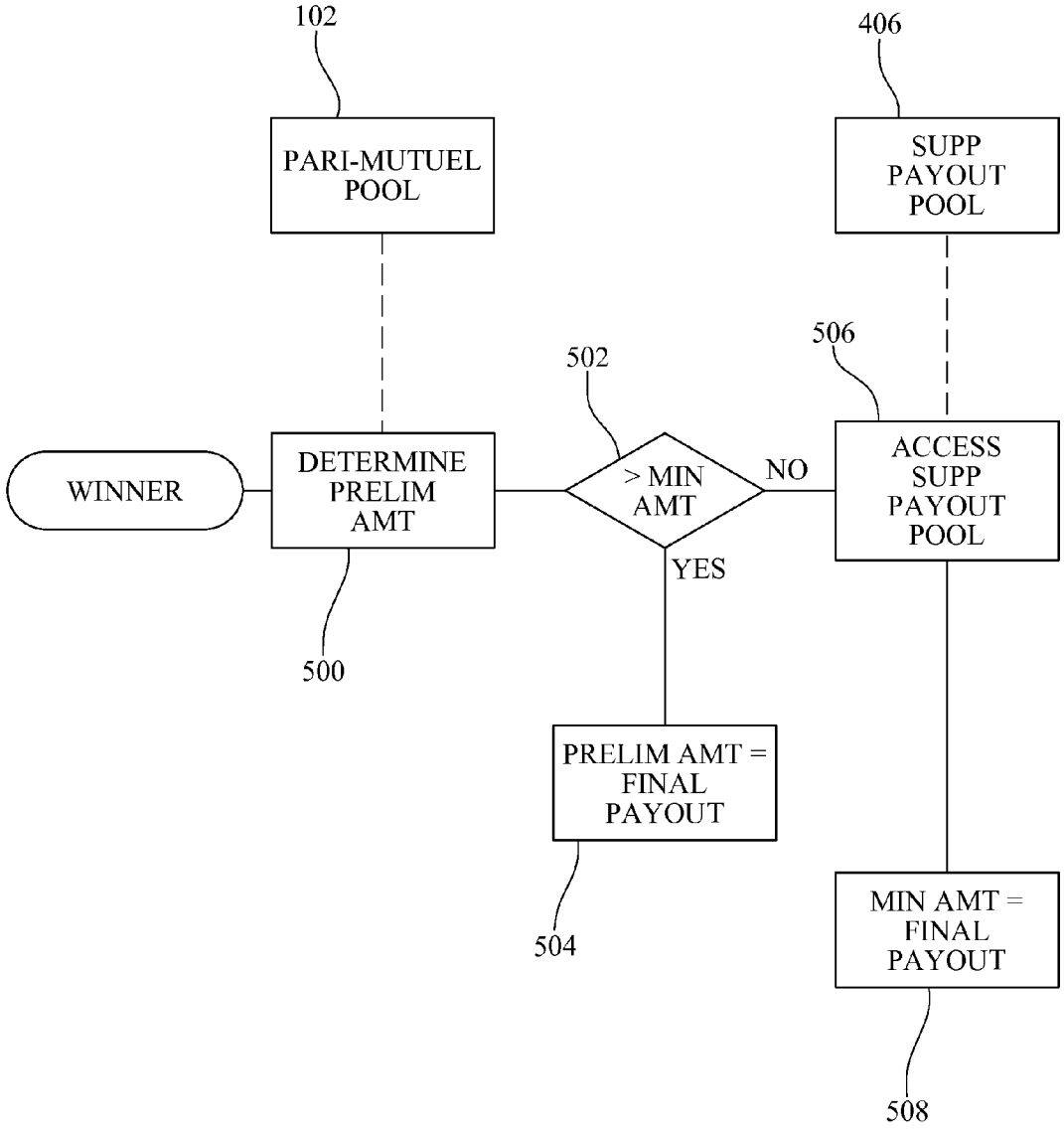
FIG. 6 is a flow chart illustrating the determination of a payout for a ticket in which the monies have been allocated as in FIG. 5.

Referring now to FIG. 6, at some future date, there will be a horse race or similar event that will determine a winning series of numbers. If a player has a matching ticket, the player is a winner and is entitled to a payout. Similar to the implementation described above with respect to FIGS. 2-3, the preliminary amount (PRELIM AMT) of the payout is determined by the amount generated by the $1 wager in the pari-mutuel pool, as indicated by block 500 of FIG. 6. Then, a determination is made by the computer server 12 at decision 502 as to whether this preliminary amount (PRELIM AMT) exceeds a predetermined minimum amount (MIN AMT). If so, that preliminary amount (PRELIM AMT) is treated as the final payout (FINAL PAYOUT) and awarded to the player, as indicated by block 504. If not, the pool 406 (FIG. 5) that is used to supplement winning payouts is accessed to make up the difference, as indicated by block 506, and the predetermined minimum amount (MIN AMT) is treated as the final payout and awarded to the player, as indicated by block 508.

One of ordinary skill in the art will recognize that additional implementations and/or embodiments are also possible without departing from the teachings of the present invention. This detailed description, and particularly the specific details of the exemplary implementations disclosed therein, is given primarily for clarity of understanding, and no unnecessary limitations are to be understood therefrom, for modifications will become obvious to those skilled in the art upon reading this disclosure and may be made without departing from the spirit or scope of the invention.

What is claimed is:

1. A method for administering a lottery in combination with a pari-mutuel pool for an event selected by a player and scheduled for a future date, comprising the steps of:

generating a ticket at a point-of-purchase terminal that includes a series of randomly generated numbers and is acquired for a purchase price;

recording the generation of the ticket at a first computer server in communication with the point-of-purchase terminal;

allocating a first portion of the purchase price to the pari-mutuel pool for the event and entering a wager in the amount of the first portion of the purchase price in the pari-mutuel pool for the event via communication between the first computer server and a second computer server managing the pari-mutuel pool for the event;

allocating a second portion of the purchase price to a supplemental payout pool;

determining, after occurrence of the event, and using the first computer server, whether the series of randomly generated numbers on the ticket matches a winning series of numbers determined by the event, and if so, determining, using the first computer server, a preliminary amount of a payout from the wager in the pari-mutuel pool for the event via communication with the second computer server that manages the pari-mutuel pool; and determining, after occurrence of the event, and using the first computer server, whether the preliminary amount of the payout from the wager in the pari-mutuel pool exceeds a predetermined minimum amount, and if not, using the supplemental payout pool to supplement the payout from the wager in the pari-mutuel pool, resulting in a final payout.

2. The method as recited in claim 1, wherein the point-of-purchase terminal includes a software-implemented random number generator that generates the series of randomly generated numbers for the ticket.

3. A method for administering a lottery in combination with a pari-mutuel pool for one or more horse races scheduled for a future date, comprising the steps of:

generating a ticket at a point-of-purchase terminal that includes a series of randomly generated numbers that correspond to entrants in the one or more horse races as selected by a player and is acquired for a purchase price;

recording the generation of the ticket at a first computer server in communication with the point-of-purchase terminal;

allocating a first portion of the purchase price to the pari-mutuel pool for the one or more horse races and entering a wager in the amount of the first portion of the purchase price in the pari-mutuel pool via communication between the first computer server and a second computer server managing the pari-mutuel pool;

allocating a second portion of the purchase price to a supplemental payout pool;

determining, after occurrence of the one or more horse races, and using the first computer server, whether the series of randomly generated numbers on the ticket matches a winning series of numbers determined by the one or more horse races, and if so, determining, using the first computer server, a preliminary amount of a payout from the wager in the pari-mutuel pool for the one or more horse races via communication with the second computer server that manages the pari-mutuel pool; and determining, using the first computer server, whether the preliminary amount of the payout from the wager in the pari-mutuel pool exceeds a predetermined minimum amount, and if not, using the supplemental payout pool to supplement the payout from the wager in the pari-mutuel pool, resulting in a final payout.

4. The method as recited in claim 3, wherein the point-of-purchase terminal includes a software-implemented random number generator that generates the series of randomly generated numbers for the ticket.

5. The method as recited in claim 3, in which a three-digit series of numbers is randomly generated and treated as a trifecta wager on one horse race.

6. The method as recited in claim 3, in which a four-digit series of numbers is randomly generated and treated as a superfecta wager on one horse race.

7. The method as recited in claim 3, in which a six-digit series of numbers is randomly generated and treated as a Pick 6 wager on six separate horse races.

8. A method for administering a lottery in combination with a pari-mutuel pool for an event selected by a player and scheduled for a future date, comprising the steps of:

generating a ticket at a point-of-purchase terminal that includes a series of player-selected numbers and is acquired for a purchase price;

recording the generation of the ticket at a first computer server in communication with the point-of-purchase terminal;

allocating a first portion of the purchase price to the pari-mutuel pool for the event and entering a wager in the amount of the first portion of the purchase price in the pari-mutuel pool for the event via communication between the first computer server and a second computer server managing the pari-mutuel pool;

allocating a second portion of the purchase price to a supplemental payout pool;

determining, after occurrence of the event, and using the first computer server, whether the series of player-selected numbers on the ticket matches a winning series of numbers determined by the event, and if so, determining, using the first computer server, a preliminary amount of a payout from the wager in the pari-mutuel pool for the event via communication with the second computer server that manages the pari-mutuel pool; and determining, using the first computer server, whether the preliminary amount of the payout from the wager in the pari-mutuel pool exceeds a predetermined minimum amount, and if not, using the supplemental payout pool to supplement the payout from the wager in the pari-mutuel pool, resulting in a final payout.

9. The method as recited in claim 8, wherein the player-selected numbers correspond to entrants in one or more horse races.

10. The method as recited in claim 9, in which the series of player-selected numbers includes three numbers and is treated as a trifecta wager on one horse race.

11. The method as recited in claim 9, in which the series of player-selected numbers includes four numbers and is treated as a superfecta wager on one horse race.

12. The method as recited in claim 9, in which the series of player-selected numbers includes six numbers and is treated as a Pick 6 wager on six separate horse races.

13. A system for administering a lottery in combination with a pari-mutuel pool for an event selected by a player and scheduled for a future date, comprising:

multiple point-of-purchase terminals, each such point-of-purchase terminal for generating tickets, each ticket including a series of randomly generated numbers and being acquired for a purchase price;

a first computer server in communication with the multiple point-of-purchase terminals for recording the generation of each ticket, said first computer server allocating a first portion of the purchase price of each ticket to the pari-mutuel pool for the event, and said first computer server allocating a second portion of the purchase price of each ticket to a supplemental payout pool; and a second computer server for managing the pari-mutuel pool for the event, said second computer server in communication with the first computer server, and said second computer server receiving and recording a wager in the amount of the first portion of the purchase price in the pari-mutuel pool associated with each ticket;

wherein, upon an occurrence of the event, said first computer server (i) determines whether the series of randomly generated numbers on each ticket matches a winning series of numbers determined by the event, and if so, determines a preliminary amount of a payout from the wager in the pari-mutuel pool for the event via communication with the second computer server that manages the pari-mutuel pool for the event, and (ii) determines whether the preliminary amount of the payout from the wager in the pari-mutuel pool exceeds a predetermined minimum amount, and if not, uses the supplemental payout pool to supplement the payout from the wager in the pari-mutuel pool, resulting in a final payout.

* * * * *